United States Patent [19]

Bovee

[11] Patent Number: 4,867,307

[45] Date of Patent: Sep. 19, 1989

[54] SKI AND POLE CASE

[76] Inventor: Dana F. Bovee, P.O. Box 3850, Ketchum, Id. 83340

[21] Appl. No.: 319,359

[22] Filed: Mar. 6, 1989

[51] Int. Cl.[4] ..... A45C 11/00; A45C 13/00; B65D 8/00; B65D 81/02

[52] U.S. Cl. ..... 206/315.1; 224/917; 206/523; 280/814; 294/147

[58] Field of Search ..... 206/315.1, 315.11, 521, 206/523; 224/917; 294/147; 220/902, DIG. 12; D3/36; 280/814, 815; 264/45.4, DIG. 1; 150/154

[56] References Cited

U.S. PATENT DOCUMENTS

| | | | |
|---|---|---|---|
| D. 230,378 | 2/1974 | Eisenberg | D3/36 |
| 1,926,916 | 9/1933 | Reeves | 206/523 X |
| 3,040,879 | 6/1962 | Planitzer | 206/523 |
| 3,181,693 | 5/1965 | Freistat | 206/523 |
| 3,767,036 | 10/1973 | McLeod | 206/315.1 |
| 3,851,689 | 12/1974 | Kohls | 206/315.1 |
| 4,131,289 | 12/1978 | Maller | 224/917 X |
| 4,306,601 | 12/1981 | Wallis et al. | 206/523 X |
| 4,643,302 | 2/1987 | Baumgardner | 206/315.1 |
| 4,715,416 | 12/1987 | Horne | 206/315.1 |

FOREIGN PATENT DOCUMENTS

| | | | |
|---|---|---|---|
| 1386945 | 12/1964 | France | 280/814 |
| 2459765 | 2/1981 | France | 220/902 |

*Primary Examiner*—Sue A. Weaver

*Attorney, Agent, or Firm*—Frank J. Dykas; Craig M. Korfanta

[57] ABSTRACT

A ski and pole case 10 constructed from a pair of hemicylindrical forms 11 and 12. The hemicylindrical forms 11 and 12 are manufactured of a closed cell water resistant cushioned foam. Each of the hemicylindrical forms 11 and 12 has a cutout 13 and 14 in its planar face. One having a cut 13 contoured to closely follow the outline of a pair of skis in base to base configuration, while the other cutout 14 is closely contoured to accept a pair of ski poles. Wrapping staps 15 are circumferentially attached to the arcuate surfaces and have an adjustable fastening means at one end. The wrapping straps 15 are attached so that when they are engaged they align the two hemicylindrical forms 11 and 12 to form a single cylinder. Strap handles 19 can also be provided and are generally disposed along a cylindrical element parallel to the longitudinal axis of the cylinder and further centralized approximately aft the cylinder's center of gravity.

7 Claims, 3 Drawing Sheets

SKI AND POLE CASE

BACKGROUND OF THE INVENTION

1. Technical Field

This invention generally relates to carrying cases for snow skis and in particular it relates to a protective snow ski carrying case particularly well suited for airline travel.

2. Background Art

Several snow ski carrying cases have been designed and patented, which provide a convenient carrying case for a pair of snow skis. A typical design is taught by KOHLS, U.S. Pat. No. 3,851,689, which discloses a bag for carrying and storing a pair of skis and is constructed of flexible substantially waterproof lightweight material. The invention is designed to cover skis during transport in a ski rack on the top or the back of an automobile. Kohls teaches the use of a very lightweight material which is flexible so that it may be folded into a very small package and easily carried within the pocket of a skier. Obviously such a material would provide the skis protection from the weather and only very, very small impacts.

HORNE, U.S. Pat. No. 4,715,416, teaches an adjustable length water ski cover. The water ski cover has two sleeves which overlap one another to cover the entire water ski. Horne, like Kohls, teaches the use of a lightweight strong flexible material, e.g. nylon fabric. Again the cover is designed for protection against water, dirt and very small impacts.

Neither the Kohls device or the Horne device, nor any prior art of which the inventor is aware, teaches a snow ski carrying case designed to withstand impacts such as those encountered in the baggage handling facilities common in airports.

Most airports, certainly all major airports, have highly automated baggage handling apparati which use conveyor belts, metal slides and the like to transport baggage to and from the various parts of the airport. Most fliers can attest to the relatively rough handling to which most baggage is subjected. Because of their long length, snow skis are prone to gross mishandling and, consequently most ski cases suffer tears and rips, to say nothing of the skis.

Therefore, what is needed is a protective ski carrying case capable of withstanding the impacts associated with airline travel and baggage handling.

It is therefore an object of the present invention to provide a protective snow ski carrier capable of protecting the skis from impact damage and at the same time resistant to tearing or ripping.

DISCLOSURE OF INVENTION

These and other objects are accomplished by a ski and pole case constructed from a pair of hemicylindrical forms. The hemicylindrical forms are manufactured of a closed cell water resistant cushioned foam. Each of the hemicylindrical forms has a cavity in its planar face. One having a cavity contoured to closely follow the outline of a pair of skis in base to base configuration, while the other cavity is closely contoured to accept a pair of ski poles. Wrapping straps are circumferentially attached to the arcuate surfaces and have an adjustable fastening means at one end. The wrapping straps are attached so that when they are engaged they align the two hemicylindrical forms to form a single cylinder.

In a second embodiment, one hemicylinder is provided with an overlap groove along the planar edge and the other one is provided with a overlap tongue along its planar edge such that when the wrapping straps are engaged the hemicylinders again form a complete cylinder with the tongue engaging the groove.

Strap handles can also be provided and are generally disposed along a cylindrical element parallel to the longitudinal axis of the cylinder and further centralized approximately aft the cylinder's center of gravity.

In use the traveling skier simply places his skis in the ski cutout and his poles in the pole cutout, closes the two hemicylindrical forms together and engages the adjustable wrapping straps with their respective adjustable fasteners. The skis and poles are then effectively protected from even the roughest of baggage handling accidents.

BEST MODE FOR CARRYING OUT INVENTION

Figure 1:
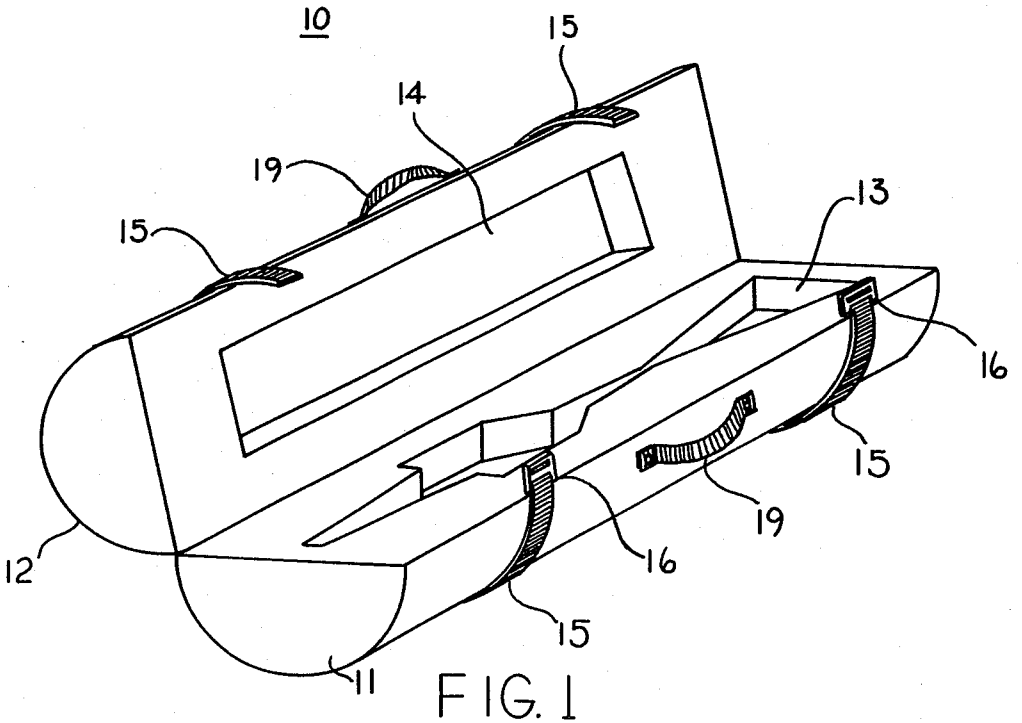
FIG. 1 is a perspective view of a ski and pole case.
Figure 2:
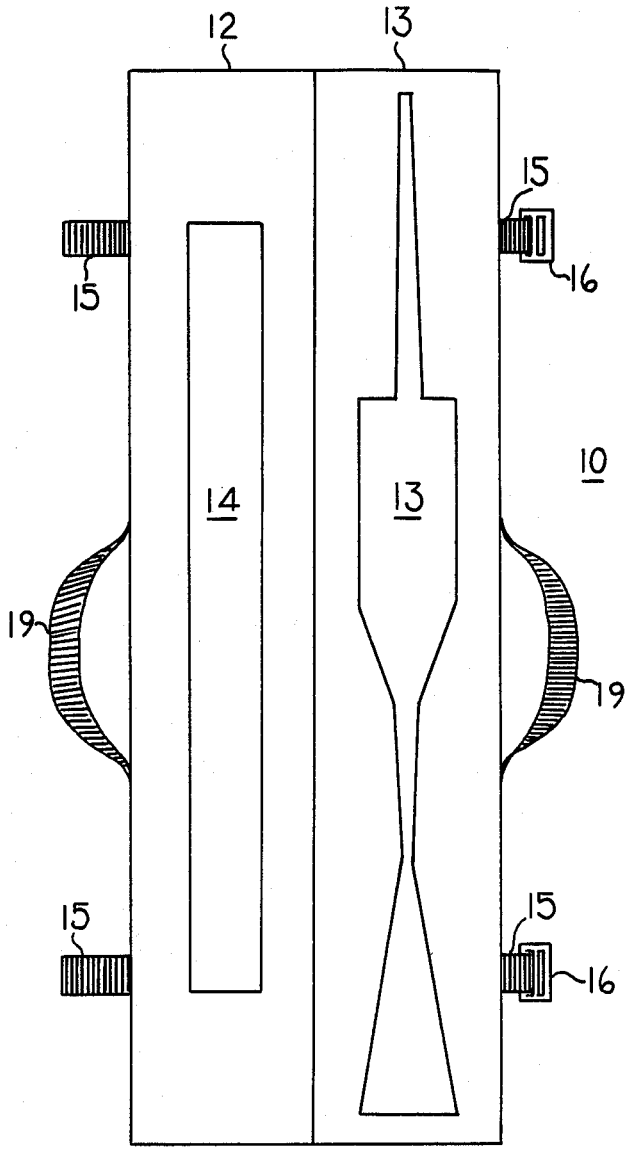
FIG. 2 is a plan view of the planar surfaces of the ski and pole case.

Referring now to FIGS. 1 and 2, ski and pole case 10 is shown having two hemicylindrical forms 11 and 12 being manufactured of a closed cell water resistant cushioned foam, such as Ensolite or neoprene. Both hemicylindrical forms have equal radii and lengths.

First hemicylinder 11 has ski cavity cutout 13 provided in its planar surface. Ski cutout 13 is contoured to closely encase a pair of snow skis in base to base configuration. Second hemicylinder 12 is provided with a generally rectangular cavity cutout 14 for receiving a pair of ski poles.

A pair of wrapping straps 15 are circumferentially attached to the arcuate surfaces of first and second hemicylindrical forms 11 and 12. Wrapping straps 15 are disposed such that first and second hemicylindrical forms 11 and 12 form a single cylinder when closed. Wrapping straps 15 further provide hinges at the interior edges of the planar surfaces of hemicylindrical forms 11 and 12.

Strap handles 19 are each attached along a cylindrical elements in close parallel spaced relation with the outer edges of the planar surfaces of first and second hemicylindrical forms 11 and 12. Strap handles 19 are further positioned to coincidentally straddle the approximate center of gravity of ski and pole case 10 so ski and pole case 10 will remain essentially parallel to the ground when carried by a traveling skier.

Figure 3:
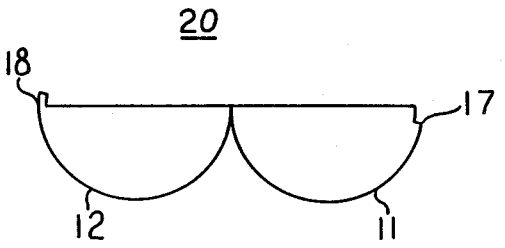
FIG. 3 is an end view of a second embodiment of the ski and pole case.

Referring now to FIG. 3, second embodiment 20 is shown in an end view which has overlap groove 17 disposed along the outer edge of the planar surface of first hemicylindrical form 11 and an overlap tongue 18 provided along the outer edge of the planar surface of second hemicylindrical form 12. The remaining features of second embodiment 20 are identical to those of the first embodiment.

In use the traveling skier simply places his skis in the ski cutout and his poles in the pole cutout, closes the two hemicylindrical forms together and engages the adjustable wrapping straps 15 with their respective adjustable fasteners 16. The skis and poles are then effectively protected from even the roughest of baggage handling accidents.

While there is shown and described the present preferred embodiment of the invention, it is to be distinctly understood that this invention is not limited thereto but may be variously embodied to practice within the scope of the following claims.

I claim:

1. A protective snow ski and pole case which comprises:

first and second foam rubber hemicylindrical forms each having a planar surface and an arcuate surface, and further a length and radius equal to the other, wherein the length is at least greater than a standard pair of skis;

said first hemicylindrical form having a cavity therein contoured to closely receive a pair of snow skis;

said second hemicylindrical form having a cavity therein contoured to closely receive a pair of ski poles; and a plurality of adjustable straps for holding said first and second hemicylindrical forms together, thereby protectively encasing a pair of skis and ski poles and forming a cylindrical protective snow ski and pole case.

2. The snow ski and pole case of claim 1 further comprising a strap handle attached to either hemicylindrical form along a cylindrical element in close space parallel relation to the outer edge of the planar surface of either hemicylindrical form and further disposed approximately coincident the center of gravity.

3. The snow ski and pole case of claim 2 further comprising an adjustable closure means attached to each of said adjustable straps for adjustably securing a strap to itself around first said hemicylindrical form and second said hemicylindrical form.

4. The ski and pole case of claim 3 wherein said adjustable straps are circumferentially attached to the arcuate surfaces of said first and second hemicylindrical forms such that when said planar surfaces of said first and second hemicylindrical forms are juxtapositioned one another, said hemicylindrical forms together define a single cylinder.

5. The ski and pole case of claim 2 wherein said adjustable straps are circumferentially attached to the arcuate surfaces of said first and second hemicylindrical forms such that when said planar surfaces of said first and second hemicylindrical forms are juxtapositioned one another, said hemicylindrical forms together define a single cylinder.

6. The ski and pole case of claim 1 wherein said adjustable straps are circumferentially attached to the arcuate surfaces of said first and second hemicylindrical forms such that when said planar surfaces of said first and second hemicylindrical forms are juxtapositioned one another, said hemicylindrical forms together define a single cylinder.

7. The snow ski and pole case of claim 1 further comprising an adjustable closure means attached to each of said adjustable straps for adjustably securing a strap to itself around first said hemicylindrical form and second said hemicylindrical form.

* * * * *